US009982678B2

(12) United States Patent
Humburg et al.

(10) Patent No.: US 9,982,678 B2
(45) Date of Patent: May 29, 2018

(54) BLOWER HOUSING, ESPECIALLY FOR A COMBUSTION AIR BLOWER OF A VEHICLE HEATER

(71) Applicant: Eberspächer Climate Control Systems GmbH & Co. KG, Esslingen (DE)

(72) Inventors: Michael Humburg, Göppingen (DE); Hermann Eppler, Balingen (DE); Erwin Burner, Lorch Weitmars (DE)

(73) Assignee: Eberspächer Climate Control Systems GmbH & Co. KG, Esslingen (DE)

( * ) Notice: Subject to any disclaimer, the term of this patent is extended or adjusted under 35 U.S.C. 154(b) by 285 days.

(21) Appl. No.: 15/041,423

(22) Filed: Feb. 11, 2016

(65) Prior Publication Data

US 2016/0245302 A1 Aug. 25, 2016

(51) Int. Cl.
*F04D 29/40* (2006.01)
*F04D 25/06* (2006.01)
*F04D 17/16* (2006.01)

(52) U.S. Cl.
CPC ..... *F04D 25/0693* (2013.01); *F04D 17/16* (2013.01); *F04D 29/403* (2013.01)

(58) Field of Classification Search
CPC ..... F04D 17/16; F04D 25/0693; F04D 29/403
See application file for complete search history.

(56) References Cited

U.S. PATENT DOCUMENTS 3,543,742 A * 12/1970 Frankle ..... B60H 1/2212 126/110 B
4,211,365 A * 7/1980 Friedl ..... B60H 1/2203 237/12.3 C
4,519,375 A * 5/1985 Galtz ..... B60H 1/2212 126/110 B
4,976,463 A * 12/1990 Soo ..... B60H 1/2209 237/12.3 B
5,012,070 A * 4/1991 Reed ..... B60H 1/00314 219/202
5,727,730 A * 3/1998 Habijanec ..... B60H 1/2212 126/110 A
6,743,012 B2 * 6/2004 Wolf ..... B60H 1/2212 165/41
7,270,098 B2 * 9/2007 Young ..... B60H 1/2206 123/142.5 R (Continued)

FOREIGN PATENT DOCUMENTS

CN 1630592 A 6/2005
CN 102777393 A 6/2005

(Continued)

*Primary Examiner* — Igor Kershteyn
(74) *Attorney, Agent, or Firm* — McGlew and Tuttle, PC

(57) ABSTRACT

A blower housing, especially for a combustion air blower of a vehicle heater, includes a first housing area (14) with a delivery channel, which extends in a ring-shaped manner around a housing axis (A) and is open on an axial side, and a second housing area (16) for accommodating a blower motor (20). The second housing area (16) includes a housing wall (18), which is elongated in the direction of the housing axis (A) and surrounds a space accommodating the motor. A connection area (26) is provided in a central longitudinal area of the housing wall (18) in the direction of the housing axis (A) on an outer side of the housing wall (18) for establishing an electric connection with an actuating device (38).

19 Claims, 4 Drawing Sheets

(56) References Cited

U.S. PATENT DOCUMENTS

| | | | |
|---|---|---|---|
| 2012/0241529 | A1 | 9/2012 | Wetzl et al. |
| 2012/0288383 | A1 | 11/2012 | Wetzl et al. |

FOREIGN PATENT DOCUMENTS

| | | | |
|---|---|---|---|
| CN | 102410255 | A | 4/2012 |
| CN | 203641052 | U | 6/2014 |
| CN | 203906334 | U | 10/2014 |
| DE | 37 40 195 | A1 | 6/1989 |
| DE | 20 2004 015 442 | U1 | 3/2006 |
| DE | 10 2010 041 139 | A1 | 3/2012 |
| DE | 10 2011 088 568 | A | 6/2013 |
| DE | 10 2013 201 598 | A | 7/2014 |
| DE | 10 2014 205 210 | A | 9/2014 |
| RU | 2053380 | C1 | 1/1996 |
| RU | 2486370 | C2 | 6/2013 |
| RU | 146113 | U1 | 9/2014 |

* cited by examiner

BLOWER HOUSING, ESPECIALLY FOR A COMBUSTION AIR BLOWER OF A VEHICLE HEATER

CROSS REFERENCE TO RELATED APPLICATIONS

This application claims the benefit of priority under 35 U.S.C. § 119 of German Patent Application DE 10 2015 102 340.7 filed Feb. 19, 2015, the entire contents of which are incorporated herein by reference.

FIELD OF THE INVENTION

The present invention pertains to a blower housing, especially for a combustion air blower of a vehicle heater, comprising a first housing area with a delivery channel, which extends in a ring-shaped manner around a housing axis and is open on an axial side, and a second housing area for accommodating a blower motor, wherein the second housing area comprises a housing wall, which is elongated in the direction of the housing axis and surrounds a space accommodating the motor.

BACKGROUND OF THE INVENTION

The post-published German patent application DE 10 2014 205 210 shows a blower housing, on which two connection areas are provided for establishing an electric connection between a blower motor in the space accommodating the motor and an actuating device for a blower comprising such a blower housing on a housing wall of a second housing area, which housing wall surrounds the space accommodating the motor, with an angular offset of 180° in relation to a housing axis and also with an axial offset in relation to one another. Due to the fact that the two connection areas are positioned opposite each other in relation to the housing axis and offset in the axial direction in the axial end areas of the housing wall, it becomes possible to arrange an actuating device to be connected to an opposite connection area in two different connection positions in relation to the blower housing and to connect it to a blower motor positioned in the space accommodating the motor in an electrically conductive manner. The strip conductor elements, which lead away from the two connection areas for electrically contacting a blower motor, are embedded in the material of which the blower housing is made in this prior-art blower housing.

SUMMARY OF THE INVENTION

An object of the present invention is to provide a blower housing, especially for a combustion air blower, which makes it possible to vary the installation position with a simple design.

This object is accomplished according to the present invention by a blower housing, especially for a combustion air blower of a vehicle heater, comprising a first housing area with a delivery channel, which extends in a ring-shaped manner around a housing axis and is open on an axial side, and a second housing area for accommodating a blower motor, wherein the second housing area comprises a housing wall, which is elongated in the direction of the housing axis and surrounds a space accommodating the motor, wherein a connection area for establishing an electric connection with an actuating device is provided in a central longitudinal area of the housing wall in the direction of the housing axis on an outer side of the housing wall.

Based on the fact that the connection area is positioned essentially symmetrically in the longitudinal direction of the second housing area or the housing wall thereof, it is possible to arrange an actuating device at one and the same connection area in at least two different connection positions in relation to the blower housing. Thus, it is not necessary to provide two connection areas that are positioned each in respective axial end areas of the housing wall.

To make it possible to use an electrically commuted blower motor for a blower configured with a blower housing according to the present invention, the connection area may advantageously comprise three connection terminals arranged essentially in a direction at right angles to the housing axis in one line or/and at equally spaced locations one after another. Due to the positioning of the three connection terminals in one line, i.e., following each other in a straight line, a symmetrical arrangement can be created in this respect as well, which makes it possible to connect an actuating device in at least two different positions in a simple manner.

To make it possible to provide connection terminals for the electric contacting of a blower motor in a simple manner in the blower housing according to the present invention, it is proposed that a connection terminal element mounting attachment projecting radially outwardly in relation to the housing axis be provided on the housing wall and that a connection terminal element having a connection terminal be inserted into the connection terminal element mounting attachment.

It is advantageous especially for use in areas subject to high thermal and also mechanical stress if the first housing area and the second housing area are made with metallic material, preferably die-cast aluminum material, and a design that can be manufactured in an especially simple manner can be obtained by the first housing area and the second housing area being made integrally in one piece with one another.

The present invention pertains, furthermore, to a blower, especially a combustion air blower for a vehicle heater, which is provided with a blower housing according to the present invention. The blower comprises, further, an actuating device with an opposite connection area for establishing an electric connection with the connection area of the blower housing, wherein a length of extension of the actuating device in the direction of the housing axis corresponds essentially to the length of extension of the second housing area in the direction of the housing axis, or/and wherein the opposite connection area at the actuating device is arranged in the direction of the housing axis essentially in a central longitudinal area of the actuating device.

It becomes possible in a simple manner with this design especially by dimensioning the actuating device in a direction that corresponds to the direction in which the housing axis extends in the installed state and also by positioning the opposite connection area in the central longitudinal area of the actuating device, viewed again in this direction, to arrange the actuating device by turning over in at least two different positions in relation to the blower housing, and the actuating device may essentially or nearly completely extend axially over the housing wall. It should be noted here that even when the length of extension of the actuating device is slightly shorter in this direction for design reasons than the length of extension of the housing wall, this corresponds to an essentially equal length of extension in the sense of the present invention.

As was stated above, it can be ensured with the embodiment according to the present invention that the connection area and the opposite connection area can be brought into connection with one another in two different connection positions.

To provide corresponding contacting possibilities at the actuating device especially when the connection area comprises three connection terminals, it is proposed that the opposite connection area comprise three opposite connection terminals in association with the three connection terminals of the connection area. The opposite connection terminals are advantageously also arranged following each other in one line or/and at mutually equally spaced locations.

The present invention pertains, further, to a method for manufacturing a housing with the above-described design. The actuating device with its opposite connection area is brought in this method into connection with the connection area of the blower housing in a first position or in a second connection position. Depending on which of the two connection positions the actuating device is positioned in relation to the blower housing, the actuating device is provided with an actuating data set associated with a respective connection position. Since the polarity and thus basically the direction of rotation of a blower motor is also reversed when a connection is established between the connection area and the opposite connection area in a different position, it can thus be ensured, in principle, according to this aspect of the present invention, by taking into account the connection position in the actuating data set to be used for the blower motor, that independently from the particular selected connection position, the motor is always actuated such that it rotates in a permanently defined direction of rotation.

The present invention will be described below in detail with reference to the attached figures.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
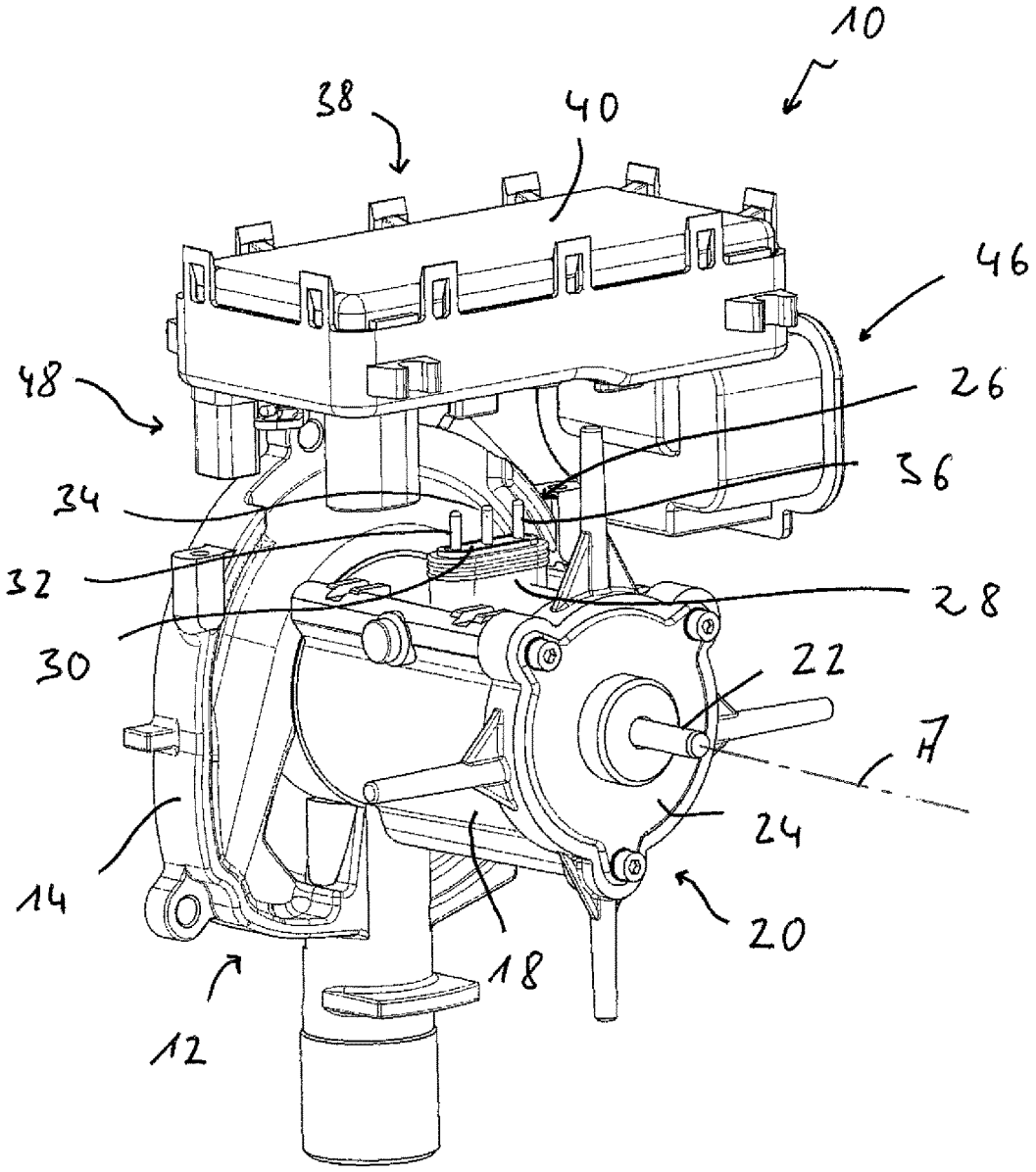
FIG. 1 is a perspective view of a blower with an associated actuating device.
Figure 2:
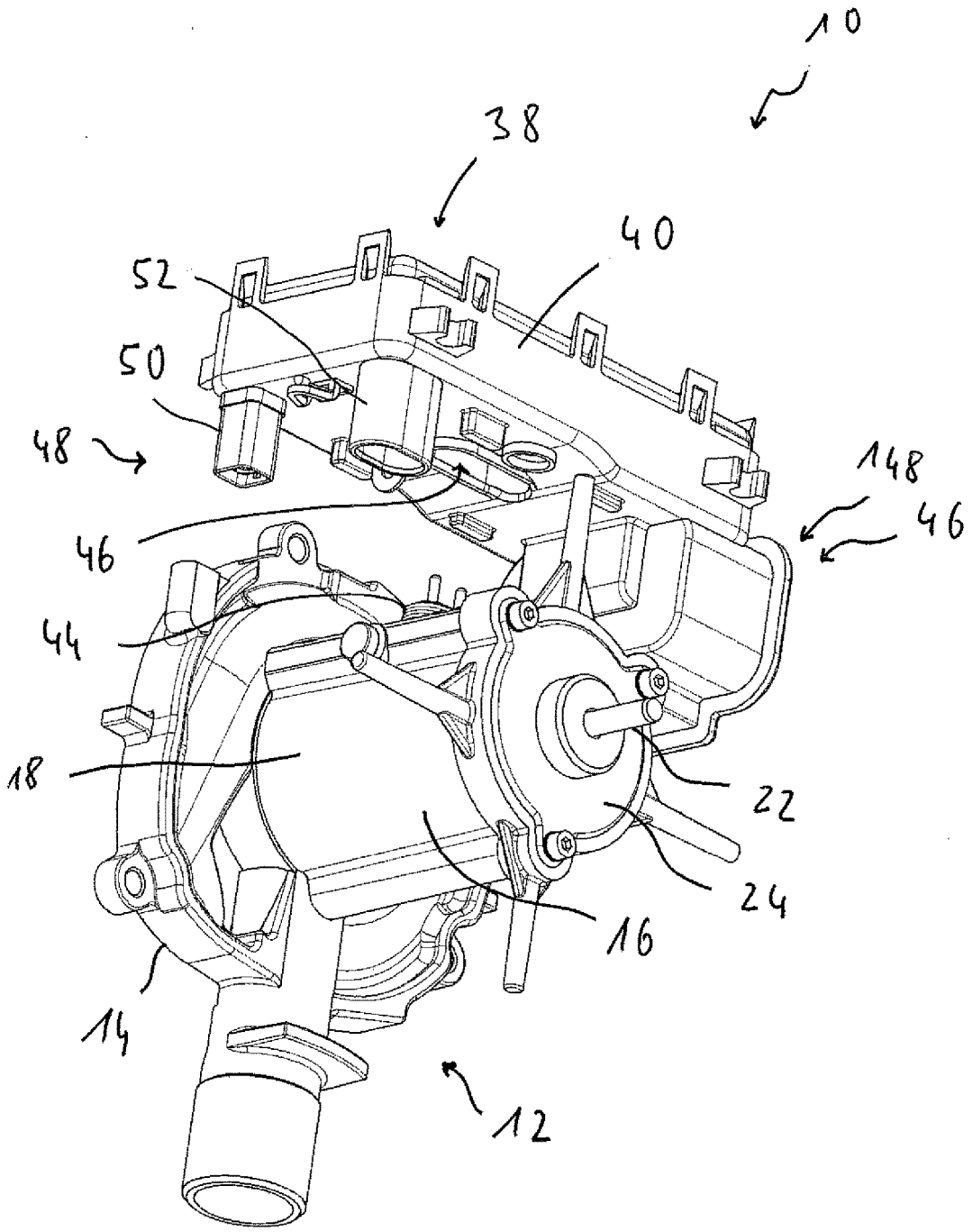
FIG. 2 is another perspective view corresponding to FIG. 1.

Referring to the drawings, a blower configured in the manner of a so-called side channel blower is generally designated by 10 in FIGS. 1 and 2. The blower 10 may be used as a combustion air blower, for example, in a fuel-operated vehicle heater. The blower 10 comprises, i.e., has, a blower housing generally designated by 12 with a first housing area 14 having an essentially disk-like design (disk configuration) and with a second housing area 16, which adjoins same and has an essentially cylindrical design. A delivery channel, which extends in a ring-shaped manner around a housing axis A and is open axially away from the second housing area 16 in the direction of the housing axis A, is provided in the first housing area 14 on the side that cannot be seen in the figures and faces away obliquely to the rear. The delivery channel is interrupted in an interruptor area between an air inlet and an air outlet.

A blower motor or the essential components of a blower motor, which is generally designated by 20 and of which only the motor shaft 22 protruding from a housing cover 24 can be seen in the Figures, is/are arranged in a space accommodating the motor, which space is surrounded by a housing wall 18. At an other end which cannot be seen in the Figures, the motor shaft 22 carries a delivery wheel covering the first housing area 14 or the delivery channel formed therein. The blower motor 20 comprises a stator area being carried, for example, on the inner side of the housing wall 18 and a rotor area rotatable with the motor shaft 22 about a housing axis.

A connection area 26 intended for electrically contacting the blower motor 20 is provided approximately in a central longitudinal area of the housing wall 18 of the second housing area 16 relative to a direction of extension in the direction of the housing axis A. The connection area 26 comprises a connection terminal element mounting attachment 28, which is formed, for example, integrally in one piece with the housing wall 18 and projects radially outwardly in relation to the housing axis A. This attachment is elongated in a direction at right angles to the housing axis A or approximately in the circumferential direction and establishes a passage opening to the space accommodating the motor.

A connection terminal element 30, whose shape is adapted to the inner contour of the connection terminal element mounting attachment 28, is inserted into the connection terminal element mounting projection 28 preferably in a fluid-tight manner or/and with a press fit. Connection in substance, for example, by bonding, it also possible. The connection terminal element 30 is preferably made of an electrically insulating plastic material and has three connection terminals 32, 34, 36, here configured as plug-type connection terminals. The three connection terminals 32, 34, 36 are arranged in a direction essentially at right angles to the housing axis A, following each other in a straight line and at mutually equally spaced locations, so that the connection terminal 34 has the same distance from the connection terminal 32 as from the connection terminal 36. By making the connection terminal elements 30 providing the connection terminals 32, 34, 36 of an electrically insulating plastic material, electrical insulation of the three connection terminals 32, 34, 36 provided thereon in relation to the blower housing 12, which is preferably made of a metallic material, for example, die-cast aluminum material, is achieved. This makes it possible to manufacture the blower housing 12 with its first housing area 14 and with its second housing area 16, especially also with the connection terminal element mounting attachment 28 provided on the housing wall 18, integrally in one piece in one manufacturing operation, for example, in a casting operation. A stable and thermally stable design with high mechanical load-bearing capacity is created by using metallic material to make the blower housing.

The blower 10 comprises, further, an actuating device generally designated by 38. The actuating device 38 may be used to actuate the blower motor 20 in the delivery operation, so that the delivery wheel being carried on the motor shaft 22 rotates at the necessary speed of rotation to provide a desired delivery rate. The actuating device 38 may also be used to actuate additional components, especially a vehicle heater, at which the blower 10 is provided.

The actuating device 38 is configured with a, for example, box-like (box-shaped configuration), advantageously multi-part actuating device housing 40. This is essentially rectangular in the top view in the example being shown and is positioned in the assembled state with its shorter housing axis GK such that this axis GK extends essentially in parallel to the housing axis A of the blower housing 12, while the longer housing axis GL extends essentially at right angles to the housing axis A or extends in the same direction in which the three connection terminals 32, 34, 36 following each other are arranged.

As is shown in FIG. 2, an opposite connection area (cooperating connection area) generally designated by 42 is provided in the actuating device 38. This opposite connection area, having a bushing-like design (bushing configuration), can be brought into connection with the blower housing 12 by plugging it onto the connection area 26 at the blower housing 12. Associated with the connection terminals 32, 34, 36 of the connection area 26, three opposite connection terminals, not shown in the figures, which are positioned likewise along a line following each other and at mutually equally spaced locations, are provided in the opposite connection area 42. When plugging the opposite connection area 42 onto the connection terminal element mounting attachment 28 projecting radially outwardly from the blower housing 12, a stable holding effect is generated, on the one hand, by the holding ribs 44 provided, for example, on the outer circumference of said mounting attachment, so that no additional measures are necessary for fixing the actuating device 38 in relation to the blower housing 12. On the other hand, the connection terminals 32, 34, 36 are brought into electrically conducting connection with the respective opposite connection terminals associated with these. The opposite connection area 42 is provided in the direction of the shorter housing axis GK approximately in a central longitudinal area of the actuating device housing.

It is seen, furthermore, in FIGS. 1 and 2 that a first connection area 46 and a second connection area 48 are provided at end areas located in the direction of the longer housing axis GL of the actuating device housing 40. With the actuating device housing 40 arranged at the blower housing 12, these respective first and second connection areas 46, 48 are located, essentially accommodating the housing wall 18 of the second housing area 16 between them, on both sides of the second housing area 16. The first connection area 46 may be used to connect the actuating device 38 to a vehicle, for example, to a data bus system or another information transmission system. The connection area 46 is configured for this purpose as a receptacle connection area, which is positioned in a direction away from the housing axis A for leading up and plugging in a complementary plug-in area of a vehicle data transmission system. The connection area 48 in the other longitudinal end area of the actuating device housing 40 may comprise, for example, a plurality of connection sections 50, 52, in which different system areas of a vehicle heater can be connected to the actuating device 38. These may be, for example, an igniting member, a temperature sensor, a fuel feed pump, an electrically excitable heater for a porous evaporating medium or the like.

Figure 3:
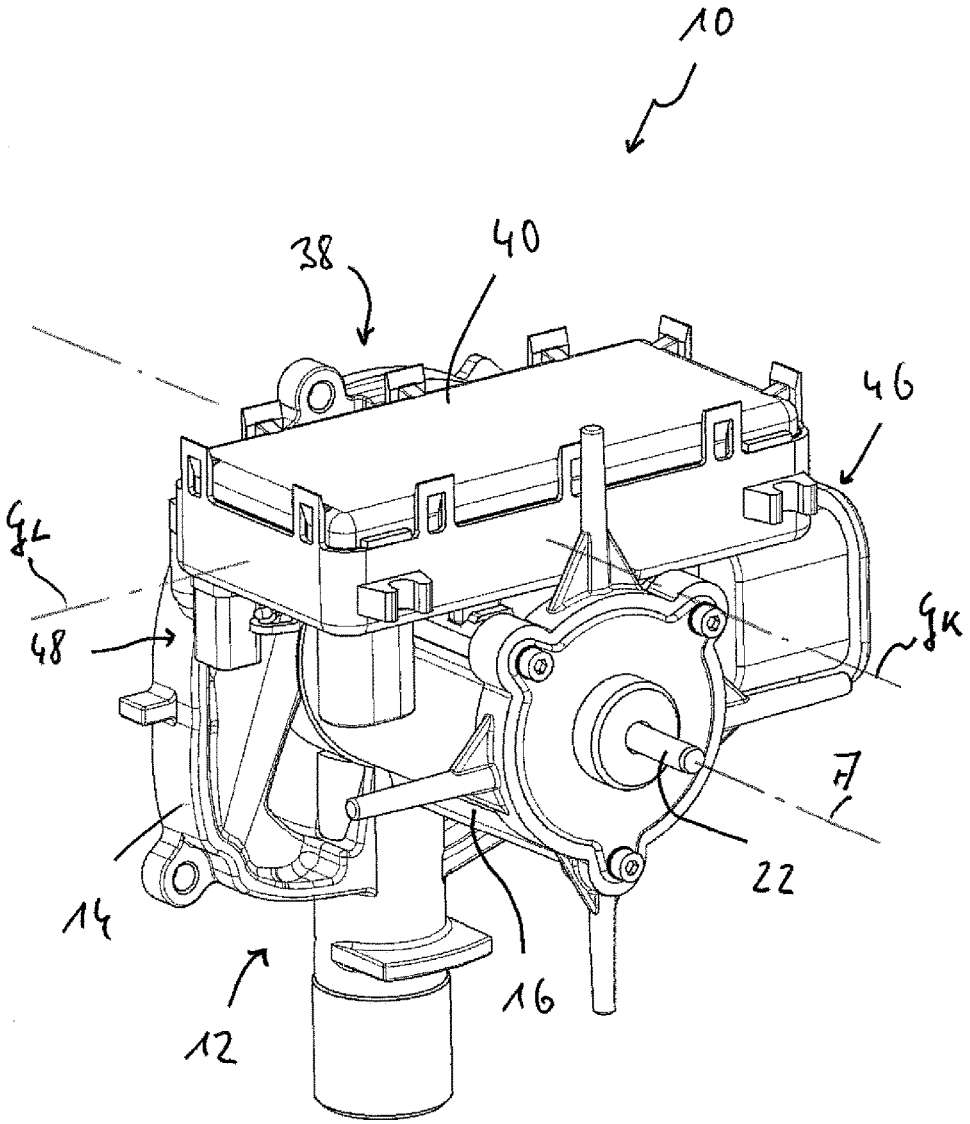
FIG. 3 is the blower with the actuating device in a first connection position.
Figure 4:
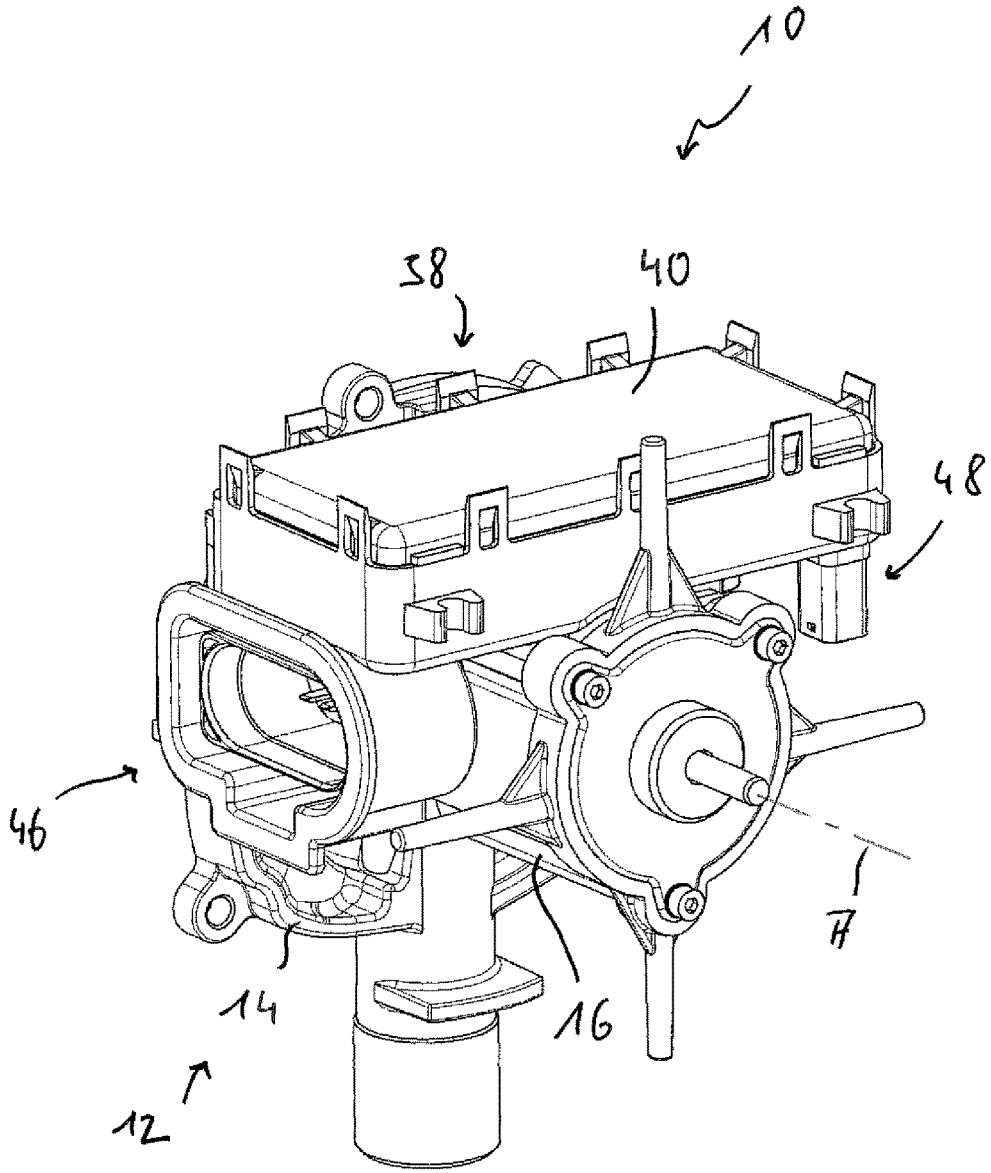
FIG. 4 is the blower with the actuating device in a second connection position.

The actuating device 38 is positioned in relation to the blower housing 12 in FIGS. 1 and 2 such that after plugging onto the connection area 26, it is in a first connection position, which can be seen in FIG. 3, in relation to the blower housing 12. When viewed in the direction of the housing axis A and in the direction of the second housing area 16 and then in the direction of the first housing area 14, the connection area 46 is located in this first connection position, for example, to the right of the housing axis A for connection to a vehicle data transmission system. FIG. 4 shows the actuating device 38 in a second connection position in relation to the housing axis 10. The actuating device 38 is rotated, for example, about a space axis that is essentially at right angles to the housing axis A by 180° in this second connection position, so that when viewed in the same direction, the connection area 46 is positioned to the left of the housing axis A. Based on the positioning of the connection terminals 32, 34, 36 and the corresponding positioning of the opposite connection terminals along a line and at uniformly spaced locations and based on the basically symmetrical design of the connection terminal element mounting attachment 28 and likewise of the opposite connection area 42, the actuating device 38 can be coupled with the blower housing 12 in these two different connection positions, and an electrical contacting of the blower motor 20 is nevertheless made possible via the three connection terminals 32, 34, 36 in each of the two connection positions. This makes it possible, adapted to a particular installation situation in a vehicle, to position the actuating device 38 in relation to the blower housing 12 such that easy access is guaranteed to the connection area 46 for a vehicle data transmission system to be connected thereto.

Since the blower motor 20 is, in general, an electrically commuted blower motor, the position of the actuating device 38, which position is rotated by 180°, also leads to a correspondingly reversed contacting of the connection terminals 32, 34, 36 with the opposite connection terminals at the opposite connection area 42. With unchanged actuation of the blower motor 20, the consequence of this would be that said blower motor would rotate in a different direction depending on the positioning of the actuating device 38 in the first connection position or in the second connection position thereof. To compensate this, a particular control data set for the blower motor 20, which data set is adapted to the selected connection position, can be stored in the actuating device 38 before or after the actuating device 38 is connected to the blower housing 12. It can thus be guaranteed that independently from the connection position of the actuating device 38, the blower motor 20 can always rotate in the same direction during the operation. This assembly of the actuating device 38 may be carried out, for example, at the end of the manufacturing operation, when the connection position is fixed, and before the blower thus configured is integrated, for example, in a vehicle heater. However, the actuating device 38 could, in principle, also be premanufactured, so that two types of actuating devices having, in principle, the same design but different programming concerning the control data set for the blower motor are kept ready, and either one type or the other type is used depending on the needs.

Finally, it should be noted that design embodiments differing, in principle, from the above-described design, which nevertheless utilize the principle of the present invention, may be selected. Thus, it is advantageous to dimension the actuating device housing 40 such that in the direction of its shorter housing axis GK, i.e., the housing axis extending essentially parallel to the housing axis A and the blower housing 12, it has a length of extension that approximately corresponds to the length of extension of the housing wall 18 in this direction and is, in general, slightly shorter in order to avoid a mutual interference with the first housing area 14.

This embodiment makes it possible to efficiently utilize the space available for installation while the variability of installation is nevertheless preserved, especially if the opposite connection area 42 is arranged approximately in the longitudinal center in the direction of the shorter housing axis of the actuating device housing 40. The actuating device housing 40 could nevertheless also be made shorter, especially in this direction, and the opposite connection terminal 42 could also be arranged, in principle, eccentrically to an extent allowing the variability in installation in the above-described sense. The number of connection terminals and of the complementary opposite connection terminals may also be selected such that it is adapted to the design of a blower motor. In particular, an additional connection terminal could be kept ready as a ground terminal or the like. Operation with only two connection terminals is also possible, in principle, for example, in case of a mechanically commuted blower motor.

While specific embodiments of the invention have been shown and described in detail to illustrate the application of the principles of the invention, it will be understood that the invention may be embodied otherwise without departing from such principles.

What is claimed is:

1. A blower housing for a combustion air blower of a vehicle heater, blower housing comprising:

a first housing area with a delivery channel, which extends annularly around a housing axis and is open on an axial side; and a second housing area for accommodating a blower motor, wherein the second housing area comprises a housing wall, which is elongated in the direction of the housing axis and surrounds a motor space accommodating a motor, wherein a connection area is provided on an outer side of the housing wall in a central longitudinal area of the housing wall in a direction of the housing axis for establishing an electric connection with an actuating device.

2. A blower housing in accordance with claim 1, wherein the connection area comprises three connection terminals arranged essentially in a direction at right angles to the housing axis following each other in a line or at equally spaced locations or both following each other in a line and at equally spaced locations.

3. A blower housing in accordance with claim 1, wherein the connection area comprises a connection terminal element mounting attachment projecting radially outwardly in relation to the housing axis at the housing wall, and a connection terminal element, having connection terminals, inserted into the connection terminal element mounting attachment.

4. A blower housing in accordance with claim 1, wherein the first housing area and the second housing area are made of a metallic material comprising die-cast aluminum material.

5. A blower housing in accordance with claim 1, wherein the first housing area and the second housing area are made integrally in one piece with one another.

6. A combustion air blower comprising:

a blower housing comprising a first housing area with a delivery channel, which extends annularly around a housing axis and is open on an axial side and a second housing area for accommodating a blower motor, wherein the second housing area comprises a housing wall, which is elongated in the direction of the housing axis and surrounds a motor space accommodating a motor, wherein a connection area is provided on an outer side of the housing wall in a central longitudinal area of the housing wall in a direction of the housing axis; and an actuating device with an opposite connection area for establishing an electric connection with the connection area of the blower housing, wherein a length of extension of the actuating device, in the direction of the housing axis, corresponds essentially to a length of extension of the second housing area in the direction of the housing axis or wherein the opposite connection area at the actuating device is arranged essentially in a central longitudinal area of the actuating device in the direction of the housing axis, or wherein a length of extension of the actuating device, in the direction of the housing axis, corresponds essentially to a length of extension of the second housing area in the direction of the housing axis and the opposite connection area at the actuating device is arranged essentially in a central longitudinal area of the actuating device in the direction of the housing axis.

7. A blower in accordance with claim 6, wherein the connection area and the opposite connection area are configured to be brought into connection with one another in a first connection position and in a second connection position.

8. A blower in accordance with claim 7, wherein the actuating device further comprises an actuating data set associated with a respective connection position depending on whether said actuating device is brought into connection with the connection area of the blower housing in the first connection position or in the second connection position.

9. A blower in accordance with claim 6, wherein:

the connection area comprises three connection terminals arranged essentially in a direction at right angles to the housing axis; and the opposite connection area comprises, associated with the three connection terminals of the connection area, three opposite connection terminals.

10. A blower in accordance with claim 9, wherein the opposite connection terminals are arranged following each other in a line or at equally spaced locations or both following each other in a line and at equally spaced locations.

11. A blower in accordance with claim 6, wherein the connection area comprises a connection terminal element mounting attachment projecting radially outwardly in relation to the housing axis at the housing wall, and a connection terminal element, having connection terminals, inserted into the connection terminal element mounting attachment.

12. A blower in accordance with claim 6, wherein the first housing area and the second housing area comprise die-cast aluminum material.

13. A blower in accordance with claim 6, wherein the first housing area and the second housing area are made integrally in one piece with one another.

14. A method for manufacturing a blower, the method comprising:

providing a blower housing comprising a first housing area with a delivery channel, which extends annularly around a housing axis and is open on an axial side and a second housing area for accommodating a blower motor, wherein the second housing area comprises a housing wall, which is elongated in the direction of the housing axis and surrounds a motor space accommodating a motor, wherein a connection area is provided on an outer side of the housing wall in a central longitudinal area of the housing wall in a direction of the housing axis;

providing an actuating device with an opposite connection area for establishing an electric connection with the connection area of the blower housing, wherein a length of extension of the actuating device, in the direction of the housing axis, corresponds essentially to a length of extension of the second housing area in the direction of the housing axis or wherein the opposite connection area at the actuating device is arranged essentially in a central longitudinal area of the actuating device in the direction of the housing axis, or wherein a length of extension of the actuating device, in the direction of the housing axis, corresponds essentially to a length of extension of the second housing area in the direction of the housing axis and the opposite connection area at the actuating device is arranged essentially in a central longitudinal area of the actuating device in the direction of the housing axis;

bringing the actuating device with the opposite connection area into connection with the connection area of the blower housing in a first connection position or in a second connection position; and providing the actuating device with an actuating data set associated with a respective connection position depending on whether said actuating device is brought into connection with the connection area of the blower housing in the first connection position or in the second connection position.

15. A method in accordance with claim 14, wherein:

the connection area comprises three connection terminals arranged essentially in a direction at right angles to the housing axis; and the opposite connection area comprises, associated with the three connection terminals of the connection area, three opposite connection terminals.

16. A method in accordance with claim 15, wherein the opposite connection terminals are arranged following each other in a line or at equally spaced locations or both following each other in a line and at equally spaced locations.

17. A method in accordance with claim 14, wherein the connection area comprises a connection terminal element mounting attachment projecting radially outwardly in relation to the housing axis at the housing wall, and a connection terminal element, having connection terminals, inserted into the connection terminal element mounting attachment.

18. A method in accordance with claim 14, wherein the first housing area and the second housing area are formed of die-cast aluminum material.

19. A method in accordance with claim 14, wherein the first housing area and the second housing area are made integrally in one piece with one another.

* * * * *